US008424731B2

(12) United States Patent
Lifshitz et al.

(10) Patent No.: US 8,424,731 B2
(45) Date of Patent: Apr. 23, 2013

(54) CHILD CARRIER

(76) Inventors: Wayne Lifshitz, Bethesda, MD (US); Jonathan Lifshitz, Lexington, KY (US)

( * ) Notice: Subject to any disclaimer, the term of this patent is extended or adjusted under 35 U.S.C. 154(b) by 773 days.

(21) Appl. No.: 12/501,908

(22) Filed: Jul. 13, 2009

(65) Prior Publication Data

US 2011/0006089 A1 Jan. 13, 2011

(51) Int. Cl.
*A47D 13/02* (2006.01)

(52) U.S. Cl.
USPC ..... 224/160; 224/158; 224/259

(58) Field of Classification Search ..... 224/158–161, 224/259, 261–263, 627, 631, 637, 645, 647, 224/651, 677, 678, 260; 119/770
See application file for complete search history.

(56) References Cited

U.S. PATENT DOCUMENTS

| | | | | |
|---|---|---|---|---|
| 652,352 | A * | 6/1900 | Doell | 224/160 |
| 781,033 | A | 1/1905 | Sutter | |
| 874,945 | A | 12/1907 | Davey | |
| 1,271,176 | A | 7/1918 | Kureczka | |
| 1,464,404 | A | 8/1923 | Blekastad | |
| 2,643,803 | A * | 6/1953 | Bates | 224/254 |
| 2,822,117 | A | 2/1958 | Mack | |
| 3,197,100 | A | 7/1965 | Thompson | |
| 3,421,670 | A | 1/1969 | Hansson | |
| 3,698,608 | A | 10/1972 | Entwistle | |
| 3,968,910 | A | 7/1976 | Dye | |
| D260,121 | S | 8/1981 | Cable | |
| 4,484,700 | A | 11/1984 | Bush | |
| D284,525 | S | 7/1986 | LeMaistre | |
| 4,739,913 | A | 4/1988 | Moore | |
| 4,836,938 | A * | 6/1989 | Kobasic | 224/155 |
| 4,848,067 | A | 7/1989 | Martinsen | |
| 4,986,458 | A | 1/1991 | Linday | |
| 4,993,612 | A | 2/1991 | Quimby | |
| 5,010,850 | A | 4/1991 | Sailer | |
| 5,178,309 | A | 1/1993 | Bicheler | |

(Continued)

FOREIGN PATENT DOCUMENTS

| | | |
|---|---|---|
| AT | 167146 | 4/1950 |
| CH | 106331 | 8/1924 |
| DE | 324389 | 3/1914 |
| GB | 907687 | 10/1962 |

*Primary Examiner* — Nathan J Newhouse
*Assistant Examiner* — Corey Skurdal
(74) *Attorney, Agent, or Firm* — Kelley Drye & Warren LLP

(57) ABSTRACT

A child carrier for carrying a child in a standing position on the back of the wearer is disclosed. The child carrier may have a shoulder harness having a first loop of material adapted to encircle a left shoulder area of a child carrier wearer, and a second loop of material adapted to encircle a right shoulder area of the wearer. The first loop of material and the second loop of material may be connected in an upper back region of the wearer. First and second handholds may be provided at the shoulder area of the first and second loops of material. The child carrier may have positions to attach accessories such as a water bottle, small enclosure for storage, and the like. In a first embodiment, a rigid or semi-rigid elongated platform having a width adapted to permit a child to stand on the platform may be suspended from the back of the shoulder harness by flexible straps, where the platform may be compact folding to allow the entire child carrier to be stored in a small pouch. In a second embodiment, individual stirrups for the child's feet may be suspended from the back of the shoulder harness.

9 Claims, 4 Drawing Sheets

U.S. PATENT DOCUMENTS

| | | | | | |
|---|---|---|---|---|---|
| D334,659 | S | | 4/1993 | Yamaguchi | |
| 5,230,451 | A | | 7/1993 | Onozawa | |
| 5,335,834 | A | | 8/1994 | Verina | |
| 5,343,980 | A | * | 9/1994 | Elfanbaum | 182/199 |
| 5,437,401 | A | | 8/1995 | Seltzer | |
| 5,437,402 | A | | 8/1995 | Ring | |
| 5,540,188 | A | | 7/1996 | Heinrichs | |
| D378,872 | S | | 4/1997 | Shimura | |
| 5,619,955 | A | | 4/1997 | Nelson | |
| 5,692,456 | A | | 12/1997 | Louks-Phillips | |
| 5,826,412 | A | | 10/1998 | Harrell | |
| 5,961,014 | A | * | 10/1999 | Knerr | 224/259 |
| 6,125,792 | A | | 10/2000 | Gee | |
| 6,173,450 | B1 | | 1/2001 | Hari | |
| 6,186,381 | B1 | | 2/2001 | Kernkamp | |
| 6,241,136 | B1 | | 6/2001 | Harriss | |
| 6,325,023 | B1 | | 12/2001 | Elnatan | |
| 6,345,745 | B1 | | 2/2002 | Harriss | |
| 6,561,394 | B2 | | 5/2003 | Pripps | |
| D481,421 | S | | 10/2003 | Barbis | |
| 6,651,594 | B1 | | 11/2003 | Bagwell | |
| 6,866,173 | B2 | | 3/2005 | Haber | |
| 7,017,525 | B2 | | 3/2006 | Leach | |
| 7,051,910 | B2 | * | 5/2006 | Sprague et al. | 224/638 |
| D524,064 | S | | 7/2006 | Sherwin | |
| 7,210,605 | B2 | | 5/2007 | Willows | |
| 7,311,578 | B2 | | 12/2007 | Stanley | |
| 7,353,779 | B2 | * | 4/2008 | Altieri | 119/770 |
| 7,384,382 | B2 | | 6/2008 | Farrah | |
| 7,484,645 | B2 | | 2/2009 | Hoff | |
| 7,484,737 | B2 | | 2/2009 | Satorius | |
| 8,056,779 | B1 | | 11/2011 | Brunwin | |
| 2003/0000974 | A1 | | 1/2003 | McUmber | |

* cited by examiner

CHILD CARRIER

FIELD OF THE INVENTION

The present invention relates to a child carrier which can be worn by an adult to carry the child in a piggy-back fashion.

BACKGROUND OF THE INVENTION

Adults, particularly parents and older siblings of a child are accustomed to having to carry the child in a piggy-back fashion. This carrying style is often referred to as a "piggy-back ride." In order to carry a child "piggy-back," the child may be positioned on the back of the person providing the ride with the child's arms draped over the shoulders of the person providing the ride. The child's legs may be supported by the arms of the person providing the ride. Typically, the child's legs are looped through the arms of the person providing the ride so that the back of the child's thighs rest against the forearm regions of the person providing the ride. The person providing the ride must then maintain their arms in a roughly ninety degree bend to provide the needed support of the child's legs. Depending on the size of the child, the child's arms may encircle the neck of the person providing the ride, or be draped over the shoulders of the person.

While providing a piggy-back ride as described above may be sustainable for short durations, it can be quite difficult for both the child and the person providing the ride to maintain the required positions over a prolonged period. One of the difficulties that can arise from a conventional piggy-back ride is the cut-off of blood circulation in the arms of the person providing the ride and the legs of the child due to the weight of the child bearing down on the person's arms. Another difficulty can arise from the child's arm fatigue resulting from having to hang on to the neck and/or shoulders of the person providing the ride, as well as choking of the person providing the ride when the child's arms encircle the person's neck. The arms of the person providing the ride may also fatigue because the person's arms must support much of the weight of the child without rest in order to give the ride. Furthermore, the ability of a child to receive a comfortable and sustainable piggy-back ride is dependent in part on the physical attributes of both the child and the person providing the ride. Both the shape, size and strength of the child and the person providing the ride will dictate whether a piggy-back ride can be accomplished at all, and if so, for how long.

Accordingly, there is a need for a child carrier that can make it easier for an adult to carry a child in piggy-back fashion. One or more embodiments of the present invention may address this need, as will be apparent from the description of such embodiments below.

SUMMARY OF THE INVENTION

Responsive to the foregoing challenges, Applicants have developed an innovative child carrier comprising: a shoulder harness having a first loop of material adapted to encircle a left shoulder area of a child carrier wearer, a second loop of material adapted to encircle a right shoulder area of the wearer, wherein the first loop of material and the second loop of material are connected in an upper back region of the wearer; a first handhold attached to the first loop of material; a second handhold attached to the second loop of material; a rigid or semi-rigid elongated platform having first and second ends distal from each other, said elongated platform having a width adapted to permit a child to stand on the platform; a first flexible strap connecting the first end of the elongated platform to the first loop of material in a lower back region of the wearer; and a second flexible strap connecting the second end of the elongated platform to the second loop of material in a lower back region of the wearer.

Applicants have further developed an innovative child carrier having an elongated platform for a child to stand on wherein the first loop of material and the second loop of material each include a means for adjusting the length of the loop of material, which is preferably an adjustable buckle; and/or further comprising a chest strap having a first piece connected to the first loop of material in a chest area of the wearer and a second piece connected to the second loop of material in a chest area of the wearer; and/or wherein the first loop of material and the second loop of material are connected in the upper back region of the wearer by a length of stretchable material; and/or further comprising a means for adjusting the length of the first flexible strap and a means for adjusting the length of the second flexible strap; and/or wherein the first loop of material and the second loop of material comprise stretchable material; and/or wherein the first flexible strap and the second flexible strap comprise stretchable material; and/or further comprising means for adjusting a location of a connection point of the first flexible strap with the first loop of material, and means for adjusting a location of a connection point of the second flexible strap with the second loop of material; and/or further comprising a rigid member attached to the first loop of material and the second loop of material in the upper back region of the wearer.

Applicants have still further developed an innovative child carrier comprising: a shoulder harness having a first loop of material adapted to encircle a left shoulder area of a child carrier wearer, a second loop of material adapted to encircle a right shoulder area of the wearer, wherein the first loop of material and the second loop of material are connected in an upper back region of the wearer; a first handhold attached to the first loop of material; a second handhold attached to the second loop of material; first and second stirrups each having a lower rigid or semi-rigid platform, each said platform having dimensions adapted to permit a child to stand on the platform with one of the child's feet; a first flexible strap connecting the first stirrup to the first loop of material in a lower back region of the wearer; a second flexible strap connecting the second stirrup to the second loop of material in a lower back region of the wearer; and a tether extending between (a) one of the first flexible strap or the first stirrup and (b) one of the second flexible strap or the second stirrup.

Applicants have further developed an innovative child carrier having individual stirrups for the child to stand in connected by a tether wherein the first loop of material and the second loop of material each include a means for adjusting the length of the loops of material, which are preferably adjustable buckles; and/or further comprising a chest strap having a first piece connected to the first loop of material in a chest area of the wearer and a second piece connected to the second loop of material in a chest area of the wearer; and/or wherein the first loop of material and the second loop of material are connected in the upper back region of the wearer by a length of stretchable material; and/or wherein the first loop of material and the second loop of material comprise stretchable material; and/or wherein the first flexible strap and the second flexible strap comprise stretchable material; and/or further comprising a means for adjusting the length of the first flexible strap and a means for adjusting the length of the second flexible strap; and/or further comprising a means for adjusting the length of the tether; and/or wherein the tether comprises stretchable material; and/or further comprising means for adjusting a location of a connection point of the first flexible strap with the first loop of material, and means for adjusting a location of a connection point of the second flexible strap with the second loop of material; and/or further comprising a rigid member attached to the first loop of material and the second loop of material in the upper back region of the wearer; and/or wherein the tether comprises flexible material; and/or wherein the tether comprises semi-rigid or rigid material.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference characters refer to like elements.

DETAILED DESCRIPTION OF EMBODIMENTS

Figure 2:
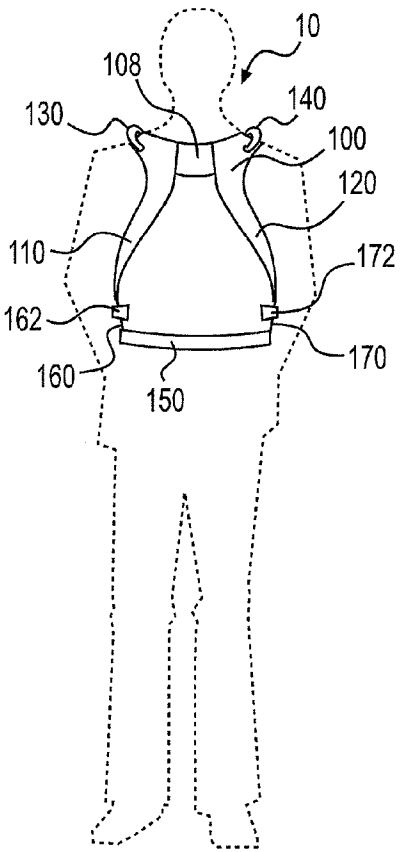
FIG. 2 is a back view of the first embodiment of the present invention having a rigid or semi-rigid elongated platform and showing the wearer in phantom.
Figure 1:
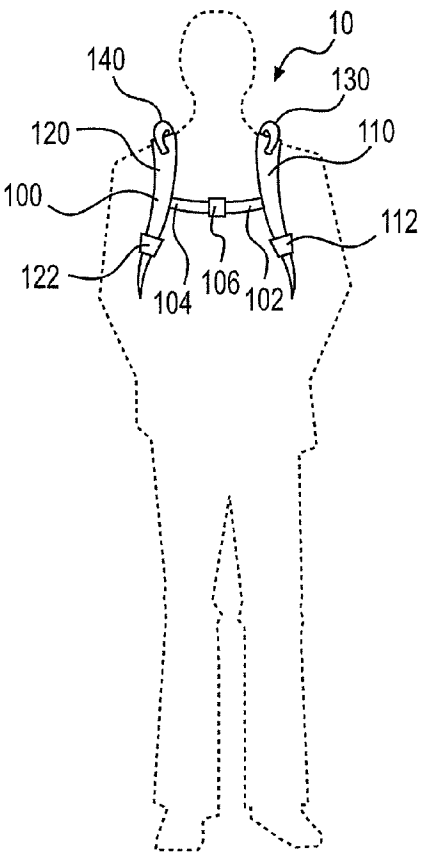
FIG. 1 is a front view of first and second embodiments of the present invention showing a wearer in phantom.
Figure 4:
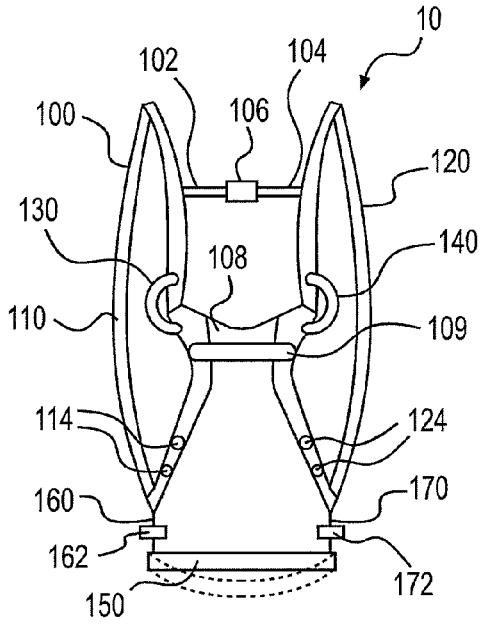
FIG. 4 is a laid-out view of the first embodiment of the present invention which permits viewing of the front and back of the child carrier.

Reference will now be made in detail to a first embodiment of the present invention, an example of which is illustrated in the accompanying drawings. FIGS. 1, 2 and 4 show a child carrier 10 in accordance with a first embodiment of the present invention. The child carrier 10 may include a shoulder harness 100 having a first loop of material 110 adapted to encircle a left shoulder area of a child carrier wearer and a second loop of material 120 adapted to encircle a right shoulder area of the wearer. The first and second loops of material 110 and 120 may be connected in an upper back region of the wearer. A short length of material 108 may form the connection between the first and second loops of material 110 and 120, or the first and second loops of material may be directly joined together. The connection of the first and second loops of material, whether it includes the length of material 108 or not, can be accomplished by any known fastening means suitable for fabric and/or flexible materials, such as sewing, adhesive, buckles, Velcro, snaps, buttons, toggles, zippers, and the like. Further, the separation distance between the first and second loops of material 110 and 120 may be adjustable. For example, if the first and second loops of material 110 and 120 are connected to the short length of material 108 by Velcro, the relative separation of the first and second loops may be easily adjusted by repositioning the connection of the Velcro loops with the Velcro hooks. Similar adjustment is readily achievable using snap, button, buckle, or like fastening means.

The first and second loops of material 110 and 120 and/or the short length of material 108 may be made of flexible fabric material. This material may also be stretchable so that it conforms more easily to the body of the wearer, and provides some shock absorbing function when supporting the weight of a child being carried. The first and second loops of material 110 and 120 may also include padding, particularly in the over-shoulder region of the loops which may make the carrier 10 more comfortable to wear. The first and second loops of material 110 and 120 may be formed of a continuously connected strip of material, or alternatively, may include a buckle, snap, Velcro, button, or zipper fastener, or the like, which provide a means for connecting a discontinuous strip of material 112 and 122 so that it forms a loop of material. Such a means for connecting the discontinuous strip of material may also serve as a means for adjusting the lengths 112 and 122 of each of the first and second loops of material 110 and 120.

A first handhold 130 may be attached to the first loop of material 110, and a second handhold 140 may be attached to the second loop of material 120. The first and second handholds may be provided in the over-shoulder region of the first and second loops of material 110 and 120. The connection points of the handholds 130 and 140 with the first and second loops of material 110 and 120 may be adjustable so as to accommodate carrying children of different sizes. Alternatively, or in addition, the lengths of the handholds 130 and 140 may be adjustable by forming them out of a discontinuous strip of material joined with a buckle, snap, Velcro, button, or zipper fastener, or the like.

With reference to the view of the back of the child carrier 10 shown in FIGS. 2 and 4, a rigid or semi-rigid elongated platform 150 may have two ends distal from each other. A first end of the elongated platform 150 may be connected to the first loop of material 110 by a first flexible strap 160, and a second end of the elongated platform 150 may be connected to the second loop of material 120 by a second flexible strap 170. The first and second flexible straps 160 and 170 may connect to the first and second loops of material 110 and 120 in the lower back region of the wearer. The first and second flexible straps 160 and 170 may be made of stretchable material to provide some shock absorbing function, and/or they may incorporate a means for adjusting the lengths of the first and second flexible straps 162 and 172, respectively, which may be provided in the form of a buckle, snap, Velcro, button, zipper fastener, or the like.

The elongated platform 150 may preferably have a width adapted to permit a child to stand on the platform, which is preferably in the range of about 10 to 24 inches, and more preferably in the range of about 15 to 18 inches. The elongated platform 150 may also be semi-rigid, such that it is capable of flexing under the weight of the child being carried so that it provides some shock absorbing function as the wearer moves up and down while walking or running. Selected wood, plastic and metal materials may provide the requisite level of semi-rigidity. The elongated platform 150 may also be provided with an anti-skid surface to reduce the likelihood of the child slipping off of it. The elongated platform 150 may also be constructed from multiple segments to allow more compact storage, as shown in FIGS. 6-10. In a first alternative embodiment of the elongated platform 150, shown in FIG. 6, the elongated platform may comprise individual segments 152 which are connected by a hinge 159, and which each have a U-shaped end piece 151 for connecting to the straps 160 and 170 (shown in FIGS. 2-4. In a second alternative embodiment of the elongated platform 150, shown in FIG. 7, the individual segments 152 may be connected by male-female threaded connectors 153 and may include non-skip material on each of the segments. In a third alternative embodiment of the elongated platform 150, shown in FIG. 8, the individual segments 152 may be connected by male-female snap-in connectors 154. In a fourth alternative embodiment of the elongated platform 150, shown in FIG. 9, the individual segments 152 may be connected by male-female dove-tail type connectors 155. In a fifth alternative embodiment of the elongated platform 150, shown in FIG. 10, the individual segments 152 may be connected by twin male-female connectors 156 which are biased into each other by a spring or stretchable cords 158 which are disposed in passages 157 extending through each of the segments 152. The elongated platforms shown in FIGS. 6-10 with separable segments 152, may be folded in a compact manner to permit easy storage and carrying of the child carrier when it is not in use. The elongated platform 150 may also be shaped as a circle, square, rectangle, triangle, hexagon, or the like in further alternative embodiments.

The first loop of material 110 may further include a means for adjusting the location of the connection point 114 of the first flexible strap 160 with the first loop of material; and the second loop of material 120 may further include a means for adjusting the location of the connection point 124 of the second flexible strap 170 with the second loop of material. The means for adjusting the location of the connection points 114 and 124 may be provided by a hook and loop arrangement, a buckle, snap, Velcro, button, zipper fastener, or the like.

With reference to FIGS. 1 and 4, which show the front of the child carrier 10, a chest strap may be provided having a first piece 102 connected to the first loop of material 110 in the chest area of the wearer and a second piece 104 connected to the second loop of material 120 in the chest area of the wearer. The chest strap first and second pieces 102 and 104 may be connected by an adjustable connector 106 provided by a buckle, snap, Velcro, button, zipper fastener, or the like.

The embodiment of the invention shown in FIGS. 1, 2 and 4, may optionally include a rigid or semi-rigid member 109 extending between and attached to the first loop of material 110 and the second loop of material 120 in the upper back region of the wearer. The rigid member 109 provides a lateral support from which the elongated platform 150 may be suspended, which may be particularly advantageous with a larger child. The rigid or semi-rigid member 109 may be readily removable and re-attachable to the shoulder harness 100 so that it can be used selectively only as needed.

Figure 3:
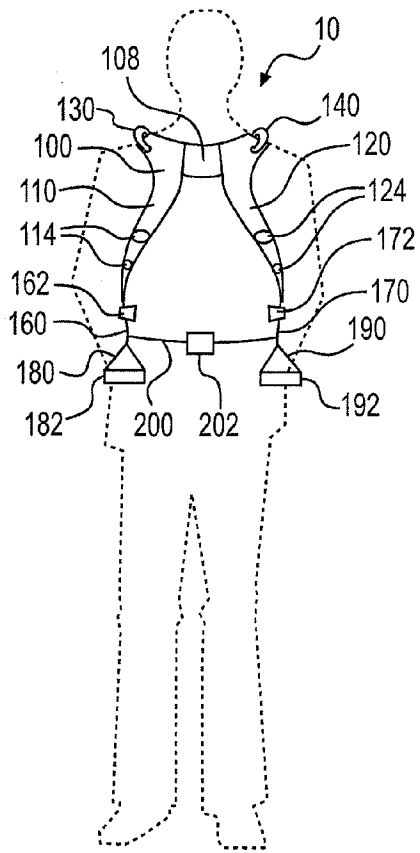
FIG. 3 is a back view of the second embodiment of the present invention having stirrups connected by a tether and showing the wearer in phantom.
Figure 5:
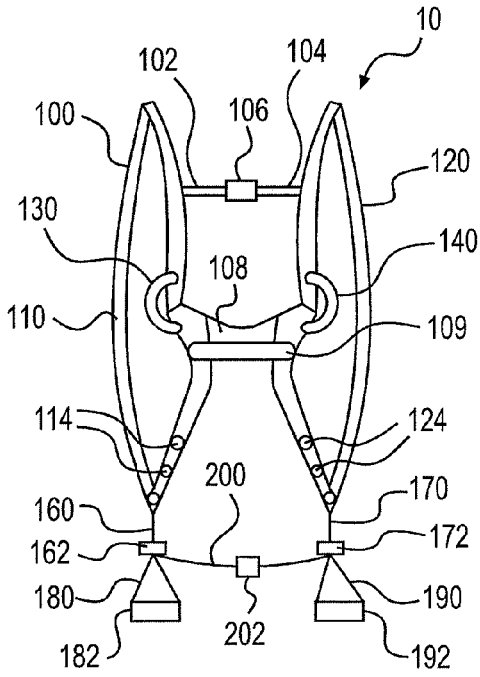
FIG. 5 is a laid-out view of the second embodiment of the present invention which permits viewing of the front and back of the child carrier.
Figure 6:
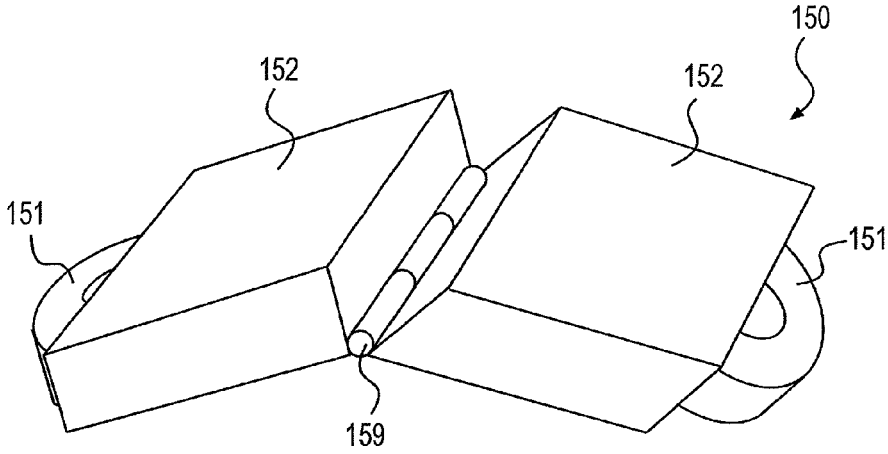
FIG. 6 is an illustration of a first elongated platform in accordance with an embodiment of the present invention.
Figure 7:
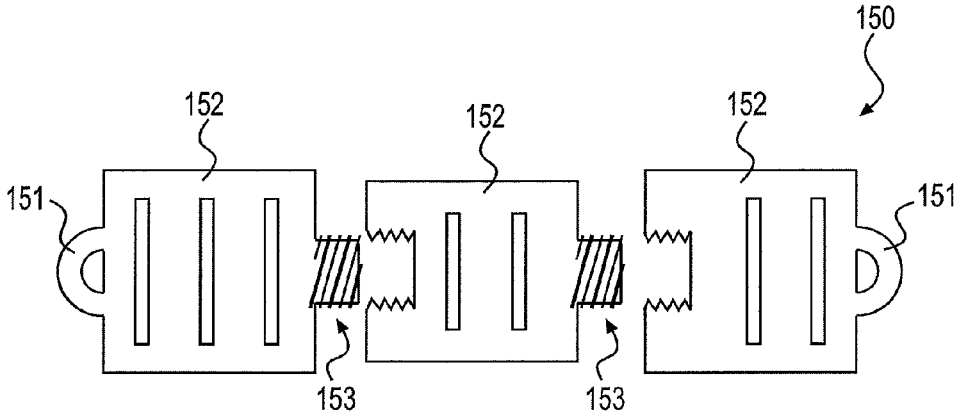
FIG. 7 is an illustration of a second elongated platform in accordance with an embodiment of the present invention.
Figure 8:
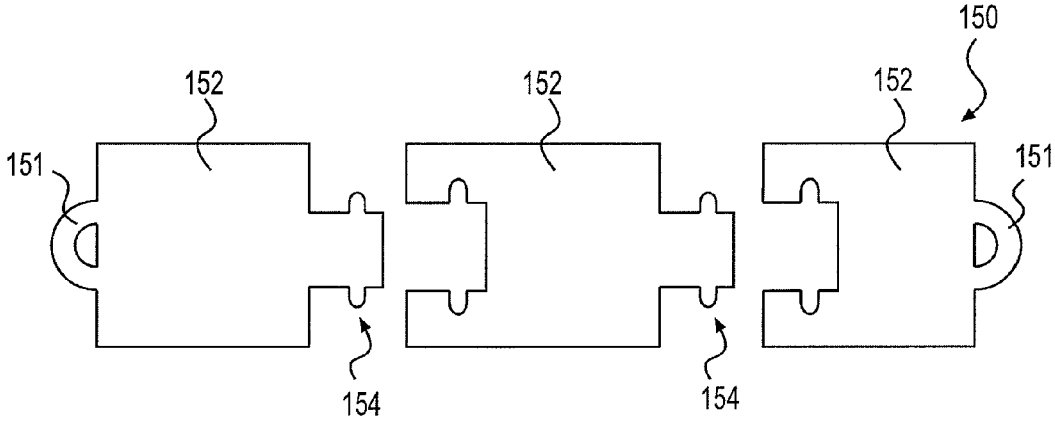
FIG. 8 is an illustration of a third elongated platform in accordance with an embodiment of the present invention.
Figure 9:
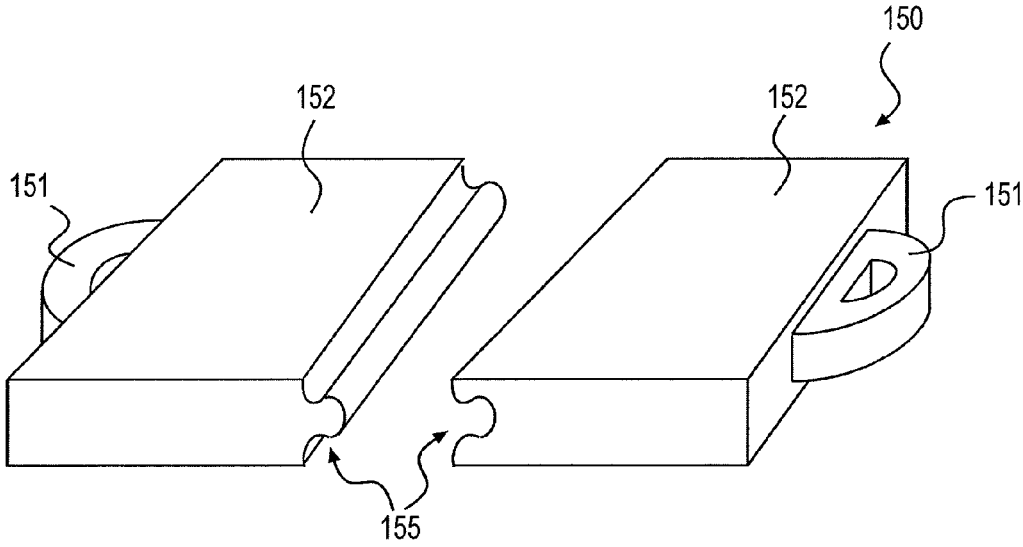
FIG. 9 is an illustration of a fourth elongated platform in accordance with an embodiment of the present invention.
Figure 10:
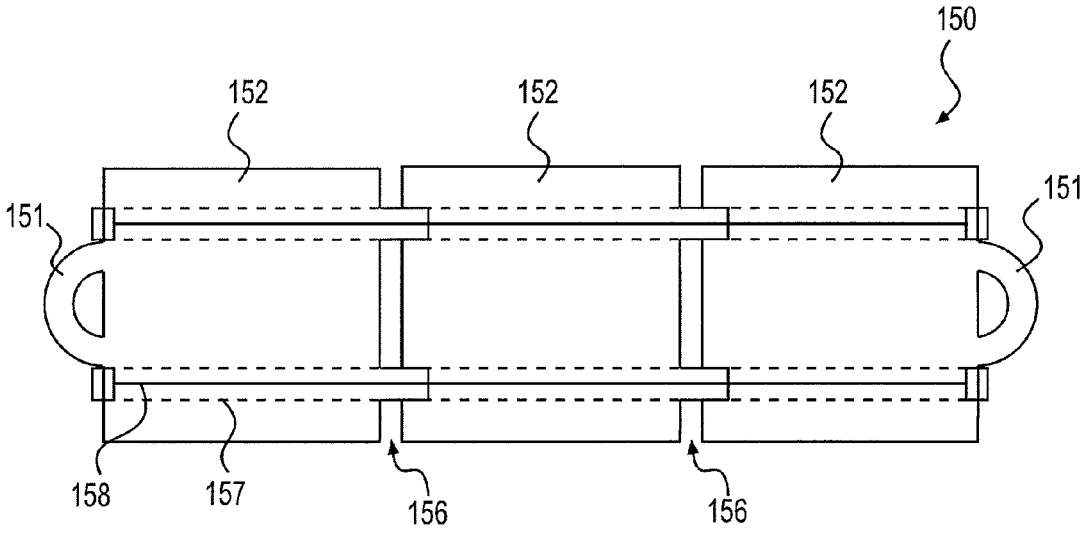
FIG. 10 is an illustration of a fifth elongated platform in accordance with an embodiment of the present invention.

With reference to a second embodiment of the present invention illustrated in FIGS. 1, 3 and 5, a child carrier 10 may include all of the same elements and features as the child carrier shown in FIGS. 2 and 4, with the exception of the elongated platform 150. In the second embodiment of the invention, the elongated platform 150 is replaced by a first stirrup 180 connected to the first loop of material 110 by the first flexible strap 160, and a second stirrup 190 connected to the second loop of material 120 by the second flexible strap 170. Each of the stirrups 180 and 190 may have respective lower rigid or semi-rigid platforms 182 and 192. Each of the lower rigid or semi-rigid platforms 182 and 192 may have dimensions adapted to permit a child to stand on the platform with one of the child's feet. Preferably the lower rigid or semi-rigid platforms 182 and 192 have lengths in the range of about 1 to 12 inches, and more preferably lengths in the range of about 2 to 9 inches, and have widths preferably in the range of about 0.5 to 6 inches and more preferably in the range of about 0.5 to 3 inches. The lower platforms 182 and 192 may be semi-rigid such that they are capable of flexing under the weight of the child being carried so that they provides some shock absorbing function as the wearer moves up and down while walking or running. Selected wood, plastic and metal materials may provide the requisite level of semi-rigidity. The lower platforms 182 and 192 may also be provided with anti-skid surfaces to reduce the likelihood of the child slipping off of them.

A tether 200 may extend between (a) one of the first flexible strap 160 or the first stirrup 180 and (b) one of the second flexible strap 170 or the second stirrup 190. The tether 200 is preferably made of flexible material, such as fabric, but can be made of semi-rigid or rigid material. The tether 200 may also be made of stretchable material to assist in accommodating (absorbing the shock of) the lateral movement of the child's feet and legs with the stirrups. The tether may further include a means for adjusting the length of the tether 202 which may be provided in the form of a buckle, snap, Velcro, button, zipper fastener, or the like.

It will be apparent to those skilled in the art that variations and modifications of the present invention can be made without departing from the scope or spirit of the invention. For example, size, shape and materials may be changed without departing from the intended scope of the invention and appended claims. It is further appreciated that forming one or more elements of the apparatus embodiments of the present invention integrally, as opposed to separately, is intended to fall within the scope of the invention and appended claims.

What is claimed is:

1. A child carrier comprising:

a shoulder harness having a first loop of material adapted to encircle a left shoulder area of a child carrier wearer, a second loop of material adapted to encircle a right shoulder area of the wearer, wherein the first loop of material and the second loop of material are connected in a back region of the harness, and wherein the first and second loops of material each have a lower back region below a point at which the first and second loops of material are connected;

a first handhold formed of a third loop of material attached to the first loop of material;

a second handhold formed of a fourth loop of material attached to the second loop of material;

a rigid or semi-rigid elongated platform having first and second ends distal from each other spaced apart along an elongated axis of said platform, said elongated platform having a width adapted to permit a child to stand on the platform;

means for suspending the first and second ends of the elongated platform from the lower back regions of the first and second loops of material, wherein said means for suspending includes a flexible strap; and means for adjusting the length of the flexible strap.

2. The child carrier of claim 1 wherein the first loop of material and the second loop of material each include a means for adjusting the length of the loop of material.

3. The child carrier of claim 1 further comprising a chest strap having a first piece connected to the first loop of material in a chest area of the wearer and a second piece connected to the second loop of material in a chest area of the wearer.

4. The child carrier of claim 1 wherein the first loop of material and the second loop of material are connected in the back region of the harness by a length of stretchable material.

5. The child carrier of claim 1 wherein the first loop of material and the second loop of material comprise stretchable material.

6. The child carrier of claim 1 wherein the flexible strap comprises stretchable material.

7. The child carrier of claim 1, further comprising:

means for adjusting locations of connection points of the suspension means to the first and second loops of material.

8. The child carrier of claim 1, further comprising a rigid member attached to the first loop of material and the second loop of material in the back region of the harness.

9. The child carrier of claim 1, wherein the elongated platform comprises two or more separable segments.

* * * * *